US006671914B2

(12) United States Patent
England et al.

(10) Patent No.: US 6,671,914 B2
(45) Date of Patent: Jan. 6, 2004

(54) CHEMICAL SHARING SYSTEM AND METHOD FOR WASHING APPLIANCES

(75) Inventors: Brent A. England, Newton, IA (US); Anthony M. Gates, Clive, IA (US)

(73) Assignee: Maytag Corporation, Newton, IA (US)

( * ) Notice: Subject to any disclaimer, the term of this patent is extended or adjusted under 35 U.S.C. 154(b) by 215 days.

(21) Appl. No.: 10/028,186

(22) Filed: Dec. 20, 2001

(65) Prior Publication Data

US 2003/0115681 A1 Jun. 26, 2003

(51) Int. Cl.[7] ..... D06F 39/02

(52) U.S. Cl. ..... 8/158; 8/159; 68/17 R; 68/207

(58) Field of Search ..... 134/94.1, 99.2; 68/17 R, 207, 12.18; 137/268, 98, 255, 387; 222/129, 332, 478; 8/158, 159

(56) References Cited

U.S. PATENT DOCUMENTS 3,033,423 A * 5/1962 Anderson et al.
3,135,429 A * 6/1964 Anderson
3,160,317 A * 12/1964 Hambro
3,188,146 A * 6/1965 Cordes
3,804,297 A * 4/1974 Jurjans
3,891,123 A 6/1975 Blackburn
4,132,242 A 1/1979 Carroll, Jr.
4,503,575 A 3/1985 Knoop et al.
4,932,227 A * 6/1990 Hogrefe
4,981,024 A 1/1991 Beldham
5,007,254 A * 4/1991 Wolfe et al.
5,167,722 A * 12/1992 Pastryk et al.
5,870,906 A * 2/1999 Denisar

* cited by examiner

*Primary Examiner*—Frankie L. Stinson
(74) *Attorney, Agent, or Firm*—McKee, Voorhees & Sease, P.L.C.

(57) ABSTRACT

A plurality of washing machines each include a washing tub and a chemical tank therein. Each of the chemical tanks is linked by an equalizing conduit at the lower end thereof so as to maintain the same level of fluid within each of the tanks.

6 Claims, 2 Drawing Sheets

CHEMICAL SHARING SYSTEM AND METHOD FOR WASHING APPLIANCES

BACKGROUND OF THE INVENTION

This invention relates to a chemical sharing system and method for washing appliances.

Commercial laundries include a number of washing appliances that must be supplied with chemical additives. In presently known systems, each washing appliance must be filled independently. This necessitates visiting each unit one at a time to resupply its chemical reservoirs.

Therefore, a primary object of the present invention is the provision of an improved chemical sharing system and method for using that system in washing appliances.

A further object of the present invention is the provision of a chemical sharing system that requires chemical fluid to be added to only one washing appliance, and distributes that chemical fluid equally to the remaining washing appliances.

A further object of the present invention is the provision of a sharing system and method which lengthens the duration for replenishing the various appliances, and which also requires that chemical additive be added to only one machine.

A further object of the present invention is the provision of a chemical sharing system and method for using same which is economical to manufacture, durable in use, and efficient in operation.

BRIEF SUMMARY OF THE INVENTION

The foregoing objects may be achieved by a combination including a plurality of washing appliances, each of which includes a washing tub and a chemical tank therein. Each of the chemical tanks comprises an upper end, a lower end, and a chemical chamber contained therein. Each of the tanks includes an inlet opening spaced above the lower end of the tank and providing fluid communication into the chemical chamber. A plurality of inlet conduits are each connected to one of the inlet openings of one of the tanks and each inlet conduit comprises an intake end for receiving fluid chemical. Each of the chemical tanks includes first and second outlet openings adjacent the lower end thereof and providing fluid communication with the chemical chamber. A plurality of equalizing conduits each have a first end connected end to the first outlet of one of the tanks and a second end connected to the second outlet of another of the tanks. This permits the fluid chemical within each of the tanks to be free to flow to all of the tanks so as to equalize the fluid level within all of the tanks.

DETAILED DESCRIPTION OF THE INVENTION

Figure 1:
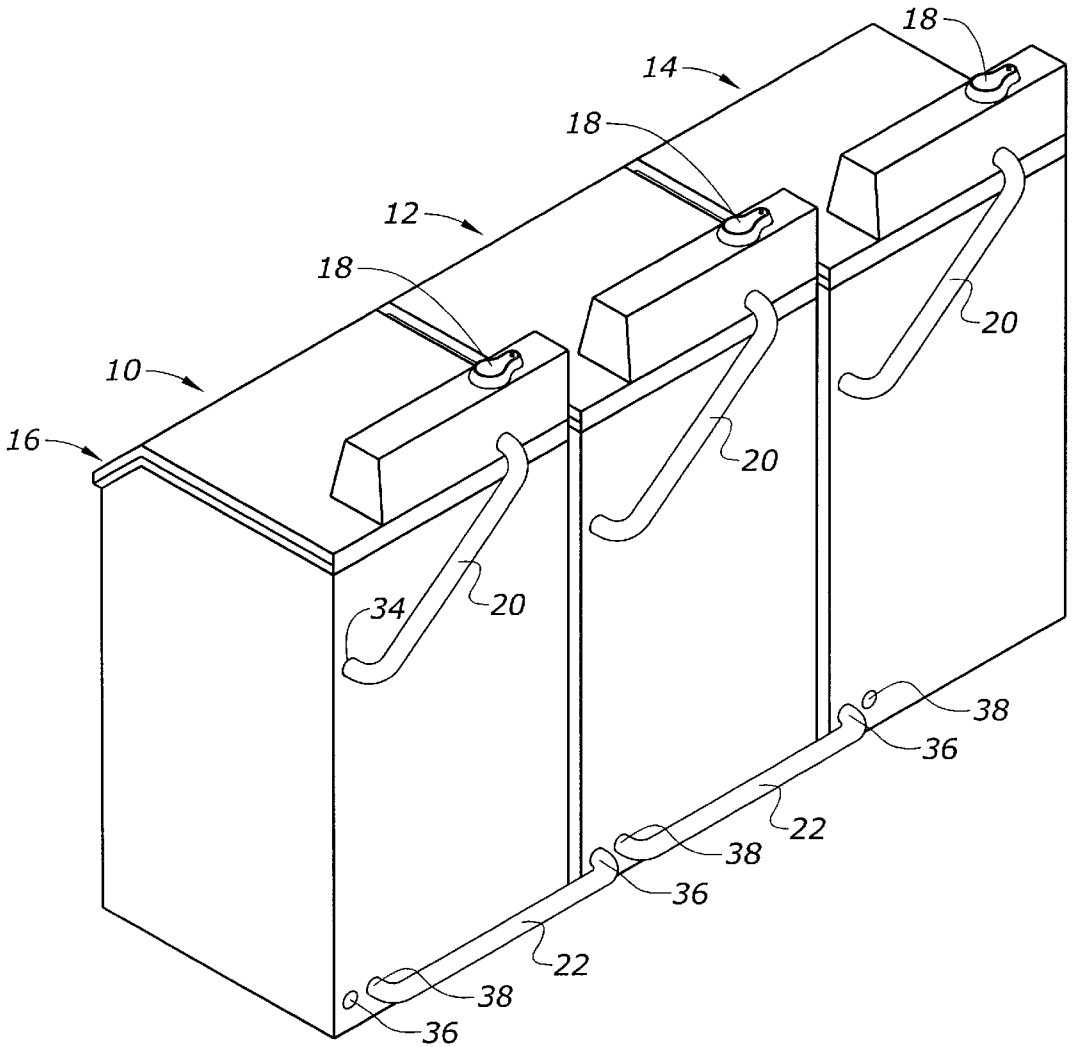
FIG. 1 is a perspective view of three washing appliances utilizing the present chemical sharing system.

Referring to the drawings the numerals 10, 12 and 14 designate three washing appliances in a typical arrangement that might be found in a commercial laundry. Each washing appliance 10, 12, 14 includes a cabinet 16. Each cabinet includes at its upper end a fill spout 18 for adding chemical additives such as liquid soap or other chemical additives. Fill spout 18 is connected to a fill conduit 20 which extends downwardly at the rear of the washing appliance. At the bottom of each washing appliance is an equalizing conduit 22 which will be connected in a manner described in more detail hereafter. Also within each washing appliance 10, 12, 14 is a washing tub 24 which is illustrated schematically in FIG. 2.

Figure 2:
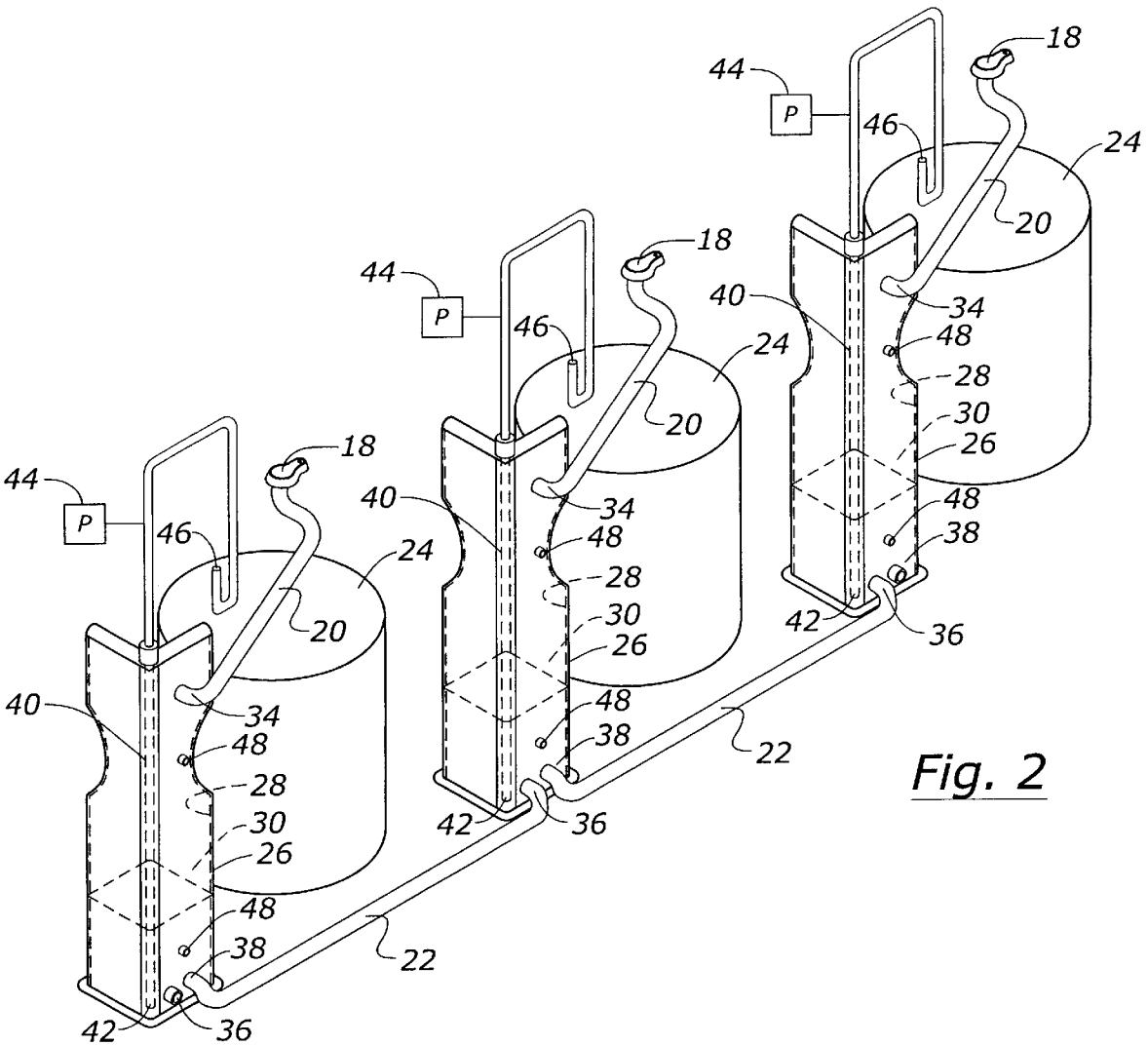
FIG. 2 is a schematic view showing the interrelationship of the chemical fluid tanks and the conduits which interconnect them.

Referring now to FIG. 2, the fill spout 18 is connected to fill conduit 20 which at its lower end is connected to an inlet boss 34 providing fluid communication into a chemical fluid tank 26 contained within each washing appliance 10, 12, 14. Each chemical tank 26 encloses a chemical chamber 28 having a chemical 30 therein.

At the bottom of each chemical tank 26 are a first outlet boss 36 and a second outlet boss 38 which provide communication into the interior of the chemical chamber 28. The first outlet boss 36 of appliance 10 is closed by a cap, and the second outlet boss 38 is connected to one end of an equalizing conduit 22. The other end of the equalizing conduit 22 is connected to the first outlet boss 36 of the adjacent washing machine 12, thereby providing fluid communication between the two tanks 26 of the washing appliances 10, 12. Similarly, a second fluid conduit 22 has one of its ends connected to the second outlet boss 38 of appliance 12 and to the first outlet boss 36 of appliance 14. The second outlet boss 38 of appliance 14 is capped.

Thus, when chemical fluid is introduced into the fill spout 18 of any one of the appliances 10, 12, 14, it passes by gravity down through fill conduit 20 into the fluid chemical chamber 28. It then flows through equalizing conduits 22 so as to equalize the fluid level within each of the tanks 26 within washing appliances 10, 12 and 14.

A delivery conduit 40 is connected at its lower end 42 to the bottom of the chemical fluid tank 26 and extends upwardly to a pump 44 and then to a discharge end 46. The pump 44 is controlled by the washing appliance and is used to introduce chemical fluid 30 through discharge end 46 into the washing tub 24.

Each of the fluid tanks 26 includes a plurality of bosses 48 which are used to attach the fluid tanks within the cabinets of the washing appliances 10, 12, 14.

The diameters of tubes 20 and 22 are relatively large so that they can easily transmit fluids of higher viscosity such as would be the case with liquid soaps.

One benefit realized with the present invention is that all units are connected in the network to share each others volume. Previously if a unit was being used more frequently than others in the area, the operator would be required to fill that individual unit more often just to resupply that one unit. With chemical sharing the operator does not have to visit all the locations, but merely needs to replenish at one of the locations when the level of all of the tanks becomes low.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. In combination:

a plurality of washing appliances, each of the washing appliances having a washing tub and a chemical tank contained therein;

each of the chemical tanks comprising an upper end, a lower end, and a chemical chamber contained therein;

each of the tanks having an inlet opening spaced above the lower end thereof and providing fluid communication into the chemical chamber;

a plurality of inlet conduits, each of which is connected to one of the inlet openings of one of the tanks, and each of which comprises an intake end for receiving fluid chemical;

each of the chemical tanks having first and second outlet openings adjacent the lower end thereof and providing fluid communication with the chemical chamber;

a plurality of equalizing conduits each having a first end connected to the first outlet of one of the tanks and a second end connected to the second outlet of another of the tanks whereby fluid chemical within each of the tanks is free to flow to all of the tanks so as to equalize the fluid level within all of the tanks.

2. A combination according to claim 1 and further comprising a delivery outlet in each of the tanks located adjacent the lower end thereof, a delivery conduit being connected to the delivery outlet and having a delivery outlet end for delivering chemical fluid from the tank to the washing tub within the washing appliance.

3. A combination according to claim 2 and further comprising a pump for pumping chemical fluid from the tank through the delivery conduit into the washing tub.

4. A method for supplying chemical fluid to a plurality of washing appliances, each comprising a washing tub and a chemical fluid tank, each of the fluid tanks forming a chemical fluid chamber therein; the method comprising:

supplying chemical fluid to one of the chemical fluid chambers of one of the tanks within through a supply conduit in communication with an inlet opening in the one fluid tank;

equalizing the chemical fluid level within all of the chemical fluid tanks by connecting the lower ends of all the fluid tanks to one another by a plurality of equalizing conduits.

5. A method according to claim 4 and further comprising delivering the chemical fluid from one of the chemical fluid chambers to one of the washing tubs.

6. A method according to claim 5 wherein the delivering step is accomplished by pumping fluid from the one chemical chamber through a delivery conduit to the one washing tub.

* * * * *